US011761092B2

(12) United States Patent
Wawrzyniak et al.

(10) Patent No.: US 11,761,092 B2
(45) **Date of Patent: *Sep. 19, 2023**

(54) METHOD FOR CORROSION-PROTECTIVE AND CLEANING PRETREATMENT OF METALLIC COMPONENTS

(71) Applicant: Henkel AG & Co. KGaA, Duesseldorf (DE)

(72) Inventors: Jerzy-Tadeusz Wawrzyniak, Duesseldorf (DE); Nils Bongartz, Haan (DE); Dalija Ehmann, Duesseldorf (DE); Henry Rossmaier, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 1115 days.

This patent is subject to a terminal disclaimer.

(21) Appl. No.: 16/432,125

(22) Filed: Jun. 5, 2019

(65) Prior Publication Data

US 2019/0284700 A1 Sep. 19, 2019

Related U.S. Application Data

(63) Continuation of application No. PCT/EP2017/079534, filed on Nov. 17, 2017.

(30) Foreign Application Priority Data

Dec. 19, 2016 (EP) ..... 16205069

(51) Int. Cl.

| | |
|---|---|
| ***C23C 22/34*** | (2006.01) |
| ***C23C 22/06*** | (2006.01) |
| ***C23C 22/50*** | (2006.01) |
| ***C23C 22/76*** | (2006.01) |
| ***C23C 22/80*** | (2006.01) |
| ***C23G 1/10*** | (2006.01) |
| ***C11D 7/10*** | (2006.01) |
| ***C11D 11/00*** | (2006.01) |
| ***C11D 7/08*** | (2006.01) |
| ***C23C 22/44*** | (2006.01) |
| ***C11D 7/26*** | (2006.01) |
| ***C23G 1/08*** | (2006.01) |
| ***C23G 1/12*** | (2006.01) |

(52) U.S. Cl.

CPC ..... *C23C 22/34* (2013.01); *C11D 7/08* (2013.01); *C11D 7/10* (2013.01); *C11D 7/261* (2013.01); *C11D 7/268* (2013.01); *C11D 11/0029* (2013.01); *C23C 22/44* (2013.01); *C23C 22/50* (2013.01); *C23C 22/76* (2013.01); *C23C 22/80* (2013.01); *C23G 1/08* (2013.01); *C23G 1/10* (2013.01); *C23G 1/125* (2013.01)

(58) Field of Classification Search

CPC ..... C23C 22/34; C23C 22/36; C23C 22/361; C23C 22/362; C23C 22/364; C23C 22/365; C23C 22/367; C23C 22/368; C23C 22/37; C23C 22/38

See application file for complete search history.

(56) References Cited

U.S. PATENT DOCUMENTS

| | | | | |
|---|---|---|---|---|
| 4,148,670 | A | 4/1979 | Kelly | |
| 2010/0260953 | A1* | 10/2010 | Tadaki | C23C 28/00 428/458 |
| 2015/0140347 | A1 | 5/2015 | Bae et al. | |

FOREIGN PATENT DOCUMENTS

| | | | |
|---|---|---|---|
| CA | 1098253 | A | 3/1981 |
| CN | 1986885 | A | 6/2007 |
| CN | 102666922 | A | 9/2012 |
| CN | 105074053 | A | 11/2015 |
| CN | 105674029 | A | 8/2016 |
| EP | 2159045 | A1 | 3/2010 |
| JP | 2001526324 | A | 12/2001 |
| JP | 2008530361 | A | 8/2008 |
| JP | 2010111904 | A | 5/2010 |
| JP | 2014504333 | A | 2/2014 |
| WO | 2012178003 | A2 | 12/2012 |

OTHER PUBLICATIONS

International Search Report of PCT/EP2017/079534, dated Mar. 8, 2018.

* cited by examiner

*Primary Examiner* — Lois L Zheng
(74) *Attorney, Agent, or Firm* — Mary K. Cameron

(57) ABSTRACT

The present invention relates to a method for the corrosion-protective and cleaning pretreatment of metallic components, produced at least partially from metallic materials from the elements iron, zinc and/or aluminum, with the use of an acid aqueous composition containing, in addition to the water-soluble compounds of the elements Zr and/or Ti causing the conversion of the metal surface, a mixture of an aliphatic diol and an aliphatic saturated polyhydroxy compound. It also comprises a chrome(VI)-free aqueous composition based on the constituents mentioned above which delivers outstanding results in cleaning and simultaneous corrosion-protective conversion of technical metal surfaces in one method step.

31 Claims, No Drawings

METHOD FOR CORROSION-PROTECTIVE AND CLEANING PRETREATMENT OF METALLIC COMPONENTS

The present invention relates to a method for anti-corrosion and cleaning pretreatment of metal components that are made at least partially of metal materials of the elements iron, zinc and/or aluminum, using an acidic aqueous composition containing, in addition to the water-soluble compounds of the elements Zr and/or Ti which bring about the conversion of the metal surface, a mixture of an aliphatic diol and an aliphatic saturated polyhydroxy compound. Also included is a chromium(VI)-free aqueous composition based on the aforementioned constituents which provides excellent results in cleaning and simultaneous anti-corrosion conversion of engineering metal surfaces in one method step.

A conversion coating is often applied to metal substrates, in particular metal components containing the materials iron, zinc and/or aluminum before the application of a protective and/or decorative coating, such as a paint. Industrial coating of a large number of components requires pretreatment in series, in which each component undergoes various treatment stages in a predetermined order. Such pretreatment in series typically comprises the separate method steps of cleaning and pretreatment and, where appropriate, coating, each process step being consistently followed by a rinsing step for the removal of active components from the preceding method step. The step of wet-chemical cleaning of the components is often to prepare said components for processing on the basis of the substrate and the type of contamination, a large number of pickling alkaline or acidic cleaners being provided as neutral cleaners for freeing the components of typical impurities, for example anti-corrosion oils, cutting oils and cooling lubricants and to condition the metal surfaces of said components for the subsequent wet-chemical pretreatment step. Meanwhile, conversion treatments often carried out on an industrial scale and aimed at temporary anti-corrosion and the provision of a suitable paint base provide the metal surfaces with amorphous inorganic coatings based on the elements Zr and/or Ti. Such conversion treatments, which can produce, for the stated purpose, wet-chemical layer deposits of 1-100 $mg/m^2$ based on the above-mentioned elements, have the advantage over conventional partly crystalline conversion layers based on phosphates of consuming fewer active components and thus saving resources and being more efficient in terms of plant technology due to a lower number of method steps and being formulated without phosphates. The prior art also describes such conversion treatment methods in which the component is cleaned and the metal surfaces of the component are converted in one step.

WO 2012/178003 A2 describes an acidic aqueous composition which is suitable for the cleaning and conversion of metal surfaces and contains a source of zirconium dissolved in water and a mixture of a cationic and nonionic surfactant, where preferably alkyl polyglycol ethers, ethoxylated fatty amines and fatty alcohols and EO/PO block copolymers are used as a nonionic surfactant and quaternized alkylammonium salts are used as cationic surfactants.

In view of this prior art, the object was to develop an alternative conversion treatment step in which the cleaning of a metal component can be performed simultaneously with the conversion in one step, the method being intended to be suitable in particular for components containing the material iron. It is additionally intended for the cleaning and conversion to be possible at the lowest possible temperatures, ideally well below 40° C., in order to avoid the formation of flash rust on the surfaces made of iron and to significantly reduce overall energy consumption in the process.

This object is achieved by means of a method for the cleaning and anti-corrosion pretreatment of a metal component which is composed at least in part of a material that consists predominantly of one or more of the metals iron, zinc and/or aluminum, by bringing the component into contact with an acidic aqueous composition containing a) at least 0.003 wt. % of aliphatic diols having at least 4 carbon atoms but no more than 10 carbon atoms;
b) at least 0.01 wt. % of aliphatic saturated polyhydroxy compounds having at least 4 but no more than 8 carbon atoms;
c) at least one water-soluble compound of the elements Zr and/or Ti;
d) at least one water-soluble source of fluoride ions.

The components treated according to the present invention can be spatial structures of any shape and design that originate from a fabrication process, in particular also including semifinished products such as strips, metal sheets, rods, pipes, etc., and composite structures assembled from said semifinished products, the semifinished products preferably being interconnected to form composite structures by means of adhesion, welding and/or flanging.

A metal material consists predominantly of the elements iron, zinc and/or aluminum if the atomic proportion of these elements in the material in total is greater than 50 at. %.

The metal material can also be a metal-coated substrate, provided that the metal coating has a layer thickness of at least 1 μm and consists of at least 50 at. % of the previously defined constituent elements. Materials of this kind are all plated ferrous materials such as electrolytically or hot dip-galvanized steel, preferably plating in the form of zinc (Z), aluminum silicon (AS), zinc magnesium (ZM), zinc aluminum (ZA), aluminum zinc (AZ) or zinc iron (ZF).

In the method according to the invention, the metal surfaces are freed in one method step from impurities from upstream production stages, such as anti-corrosion oils, cutting oils and cooling lubricants, and an anti-corrosion paint base in the form of a conversion coating is applied. In particular, sufficient cleaning and anti-corrosion conversion of the metal surfaces can be achieved in the method according to the invention even at relatively low working temperatures. Overall, the method according to the invention also allows the pretreatment of components in systems in which there are only a few treatment stages, the process economy additionally benefiting from the fact that the method can be operated even at low working temperatures.

The treatment of components that consist at least in part of ferrous materials has proven in particular to be advantageous for the method according to the invention. In comparison with the other metal materials, a greater improvement of the cleaning effect and the promotion of an anti-corrosion paint base can be detected on the surfaces of the ferrous materials. A ferrous material is characterized in that its iron content is more than 50 at. %. Preferred ferrous materials are steel, with steel including metal materials of which the mass fraction of iron is greater than that of every other element, and of which the carbon content, without taking into account carbides, is less than 2.06 wt. %.

A significant advantage of the method according to the invention is that the cleaning of auxiliary agents based on organic compounds, for example anti-corrosion oils, cutting oils and cooling lubricants, from upstream production stages, from the metal surfaces of the component can be carried out successfully even at relatively low working temperatures. In a preferred embodiment of the method according to the invention, the bringing into contact of the acidic aqueous composition therefore takes places when the temperature of the composition is less than 40° C., particularly preferably less than 35° C., more particularly preferably less than 30° C., but preferably at least 20° C. In this context it is also preferable for the contacting of the acidic aqueous composition in the method according to the invention to take place by spraying on or spraying, particularly preferably by spraying, more particularly preferably at a spray pressure of at least 1 bar, in order to achieve optimal cleaning and rapid conversion of the metal surfaces.

Because the surfaces are freed of auxiliary agents based on organic compounds upon the component being brought into contact with the acidic aqueous composition, it is possible to completely dispense with a preceding cleaning step. In a preferred embodiment of the method according to the invention, there is therefore no wet-chemical cleaning of the component directly before the component is brought into contact with the acidic aqueous composition, preferably by means of spraying on or spraying.

According to the invention, wet-chemical cleaning is cleaning by bringing into contact with a water-based composition that contains in total at least 0.1 wt. % of surfactants and/or wetting agents, in which surfactants and/or wetting agents comprise all organic compounds that lower the surface tension of water at 20° C. and at a proportion of 0.1 wt. %, determined using the Wilhelmy plate method.

Directly after the component has been brought into contact with the acidic aqueous composition, with or without an intermediate rinsing and/or drying step, in the method according to the invention the regions of the component which have previously been brought into contact with the acidic aqueous composition are preferably coated at least in part, preferably immersion coated, in particular electrocoated, or powder coated.

A "rinsing step" within the meaning of the present invention denotes a process which is intended solely to remove as far as possible, from the surface of the component, active components from an immediately preceding wet-chemical treatment step, which are dissolved in a wet film adhering to the component, by means of a rinsing solution, without replacing the active components to be removed with other active components. Active components in this context are constituents contained in a liquid phase which bring about an analytically detectable coating of the metal surfaces of the component with elemental constituents of the active components.

A "drying step" within the meaning of the present invention denotes a process in which the surfaces of the metal component having a wet film are intended to be dried with the aid of technical measures, for example supplying thermal energy or passing an air stream.

The aliphatic diol according to component a) to be used in a method according to the invention is preferably selected from diols of which the hydroxyl groups are interconnected by means of no more than 3 carbon atoms, and particularly preferably selected from acyclic alkane diols which have no more than 8 carbon atoms but preferably at least 5 carbon atoms, and more particularly preferably 2-methylpentane-2, 4-diol.

The aliphatic polyhydroxy compound according to component b) to be used in a method according to the invention is an aliphatic compound having more than two hydroxyl groups, preferably more than three hydroxyl groups, in which preferably at least two hydroxyl groups are interconnected by means of no more than two carbon atoms ("vicinal hydroxyl groups"). Particularly preferably, the polyhydroxy compound according to component b) is an alditol that in turn preferably has no more than 6 carbon atoms and is particularly preferably selected from erythritol, threitol, xylitol, arabitol, ribitol, mannitol or sorbitol, and more particularly preferably is sorbitol.

An excellent cleaning performance is achieved if the ratio by mass of polyhydroxy compounds according to component b) to diols according to component a) is at least 0.4. Such a relative minimum amount of polyhydroxy compounds according to component b) is therefore preferred in the method according to the invention. Particularly preferably, the aforementioned ratio is at least 1.0, particularly preferably at least 2.0. If relative proportions of polyhydroxy compounds according to component b) are too high, in the case of an otherwise constant total amount of active components a) and b), the high cleaning performance cannot be maintained and the simultaneous conversion of the metal surface also loses homogeneity. Accordingly, it is preferable in the method according to the invention for the ratio by mass of polyhydroxy compounds according to component b) to diols according to component a) to be no greater than 20.0, particularly preferably no greater than 10.0, more particularly preferably no greater than 6.0.

For a sufficient conversion of the metal surfaces of the component, it is advantageous for the proportion of water-soluble compounds of the elements Zr and/or Ti according to component c) in an acidic aqueous composition of the method according to the invention to be in total at least 0.002 wt. %, particularly preferably at least 0.005 wt. %, calculated as an amount Zr, where, for economic reasons and to prevent overpickling of the conversion layer, preferably in total no more than 0.2 wt. % of water-soluble compounds of the elements Zr and/or Ti calculated as an amount Zr are contained in an acidic aqueous composition of the method according to the invention.

Suitable representatives of the water-soluble compounds of the elements Zr and/or Ti according to component c) are compounds that dissociate in aqueous solution into anions of fluoro complexes. Preferred compounds of this kind are, for example, $H_2ZrF_6$, $K_2ZrF_6$, $Na_2ZrF_6$ and $(NH_4)_2ZrF_6$ and the analogous titanium compounds. Fluorine-free compounds of the elements Zr or Ti, in particular of the element Zr, can also be used according to the invention as water-soluble compounds, for example $(NH_4)_2Zr(OH)_2(CO_3)_2$ or $TiO(SO_4)$. In a preferred embodiment of the method according to the invention, fluorometallates of the elements Zr and/or Ti, and the fluoro acids thereof, particularly preferably hexafluorozirconates and/or hexafluorotitanates, and the free acids thereof, are contained in the acidic aqueous composition.

Moreover, an acidic composition of the method according to the invention contains a source of fluoride ions as component d), which is necessary for a homogeneous and reproducible, anti-corrosion conversion coating on the metal surfaces of the component. Any inorganic compound that can release fluoride ions when dissolved or dispersed in water is suitable as a source of fluoride ions. Complex or simple fluorides constitute one preferred source of fluoride ions. A person skilled in the art understands simple fluorides as being hydrofluoric acid and salts thereof such as alkali fluorides, ammonium fluoride or ammonium bifluoride, while, according to the invention, complex fluorides are coordination compounds in which fluorides are present in a coordinated manner as ligands of one or more central atoms. Accordingly, preferred representatives of the complex fluorides are the aforementioned fluorine-containing complex compounds of the elements Zr, Ti or Si.

The proportion of compounds that are a source of fluoride ions in an acidic aqueous composition of the method according to the invention, is preferably at least large enough that the acidic aqueous composition contains a quantity of free fluoride of at least 0.01 g/kg, but preferably no more than 0.6 g/kg, particularly preferably no more than 0.2 g/kg. The free fluoride content is determined at 20° C. directly in the acidic aqueous composition by means of a calibrated fluoride-sensitive electrode.

Moreover, for optimum conversion, in particular of the surfaces made of iron, by bringing into contact according to the invention with an acidic aqueous composition, it is preferable for the molar ratio of total fluoride content to the total quantity of the elements Zr and/or Ti according to component c) to be greater than 4.5, preferably greater than 5.0, particularly preferably greater than 5.5. The total fluoride proportion is determined at 20° C. using a fluoride-sensitive electrode in a TISAB-buffered aliquot portion of an acidic aqueous composition of the method according to the invention (TISAB: "total ionic strength adjustment buffer"), with the mixture ratio by volume of buffer to the aliquot portion of the acidic aqueous composition being 1:1. The TISAB buffer is prepared by dissolving 58 g NaCl, 1 g sodium citrate and 50 mL glacial acetic acid in 500 mL deionized water ($K<1\ \mu Scm^{-1}$), setting a pH of 5.3 using 5 N NaOH and filling to a total volume of 1000 mL, again with deionized water ($K<1\ \mu Scm^{-1}$).

The cleaning and simultaneous conversion, according to the invention, of the metal surfaces of the component to an anti-corrosion coating based on the elements Zr and/or Ti take place in an acidic aqueous composition. Here, for optimal process results, it is necessary to set a balance between pickling rate and cleaning performance on one side and stability of the active components on the other side. It has been found in this connection that the pH of the acidic aqueous composition is preferably above 2.0, particularly preferably above 3.0, more particularly preferably above 4.0, since even pickling rates that are low are sufficient for bringing about effective cleaning of the metal surfaces. Nevertheless, for the provision of homogeneous conversion coatings, a specific pickling rate is required for forming an alkaline diffusion layer on the metal surfaces within which the precipitation of the layer components takes place. In this connection, according to the invention, methods are preferred in which the acidic aqueous composition has a pH of below 6.0, particularly preferably below 5.5, the acidic aqueous composition preferably having a free acid content of at least 1 point. The free acid is determined by diluting 2 mL of the acidic aqueous composition to 50 mL using deionized water ($K<1\ \mu Scm^{-1}$), and titrating using 0.1 N caustic soda to a pH of 5.5. The consumption of acid solution in mL indicates the score of the free acid.

It has also been found to be advantageous for the cleaning performance for an acidic aqueous composition in the method according to the invention to additionally contain calcium and/or magnesium ions, particularly preferably in total at least 0.01 wt. % of calcium and magnesium ions, more particularly preferably at least 0.01 wt. % of magnesium ions. Preferred sources of magnesium and/or calcium ions are their nitrates.

In a preferred embodiment of the method according to the invention, in order to accelerate the conversion of the metal surfaces that are brought into contact with the acidic composition, the acidic aqueous composition additionally contains at least one water-soluble compound that is a source of copper ions, preferably in the form of a water-soluble salt, for example copper sulfate, copper nitrate and copper acetate. The presence of copper ions is also advantageous for the anti-corrosion properties of the conversion coating formed on the metal surfaces of the components over the course of the conversion. The content of copper ions from water-soluble compounds in the acidic aqueous composition is preferably at least 0.001 g/kg for this purpose, particularly preferably at least 0.005 g/kg. However, the content of copper ions is preferably not above 0.1 g/kg, particularly preferably not above 0.05 g/kg, since the deposition of elemental copper otherwise begins to dominate in relation to the formation of the conversion coating.

Moreover, for a fast and reproducible conversion of the metal surfaces, it is preferable according to the invention for the acidic aqueous composition in methods according to the invention to additionally contain at least one water-soluble compound that has a standard reduction potential at pH 0 of above +0.6 V (SHE) and is preferably selected from inorganic nitrogen compounds, particularly preferably from nitric acid and/or nitrous acid and salts thereof. In order to accelerate the formation of the conversion coating, the proportion of water-soluble compounds is preferably at least 0.001 mol/L, more preferably at least 0.01 mol/L, but, for economic reasons, preferably less than 0.2 mol/L.

In the method according to the invention, cleaning and simultaneous conversion of the metal surfaces is intended to take place with a coating that temporarily protects against corrosion, which in turn represents only a thin, almost completely inorganic, amorphous coating based on the elements Zr and/or Ti. Properties of a paint primer are not intended to be conferred in the course of the cleaning and coating according to the invention. Therefore, in a preferred embodiment, the weight proportion of organic compounds having a boiling point or decomposition point above 150° C. in the acidic aqueous composition which are not compounds of components a) and b) is less than 50%, based on the total content of organic compounds, particularly preferably less than 20%, more particularly preferably less than 10%.

The present invention further comprises an acidic aqueous chromium(VI)-free and phosphate-free composition for cleaning and simultaneous conversion of the metal surfaces of a corresponding component, containing a) 0.003-2 wt. % of aliphatic diols having at least 4 carbon atoms but no more than 10 carbon atoms;
b) 0.01-5 wt. % of aliphatic saturated polyhydroxy compounds having at least 4 but no more than 8 carbon atoms;
c) 0.002-0.2 wt. % of water-soluble compounds of the element Zr calculated as an amount Zr;
d) at least 10 mg/kg of free fluoride ions; and
e) preferably 0.01-1 wt. % of calcium and/or magnesium ions.

According to the invention, a composition is "phosphate-free" if the proportion of phosphates dissolved in water is less than 100 mg/kg, preferably less than 20 mg/kg, calculated as the amount of phosphorus.

According to the invention, a composition is "chromium (VI)-free" if the proportion of compounds of the element chromium dissolved in water in the oxidation stage +VI is less than 100 mg/kg, preferably less than 20 ppm.

Preferred embodiments of the acidic aqueous chromium (VI)-free and phosphate-free composition are analogous to those previously described in the context of the method according to the invention for the cleaning and anti-corrosion pretreatment of a metal component with respect to the acidic aqueous composition.

EXAMPLE

Oiled steel sheets (Gardobond® MBS 30, Chemetall GmbH) were subjected to a cleaning conversion treatment.

The treatment was carried out in a spray chamber at a spray pressure of 1-2 bar for 60 seconds at 25° C. and a pH of the aqueous conversion solution of 4.6.

The conversion solution contained

| | |
|---|---|
| 0.16 g/L | hexafluorozirconic acid |
| 0.32 g/L | magnesium nitrate hexahydrate |
| 0.3 g/L | sorbitol |
| 0.1 g/L | 2-methylpentane-2,4-diol |

In the water rupture test immediately after the treatment, no rupture of the running water film was observed after wetting with city water and, even after ten minutes of the metal sheets being stored in the spray chamber after cleaning conversion treatment having been carried out, no flash rust was detectable.

The invention claimed is:

1. A method for cleaning and anti-corrosion pretreatment of a metal component which is at least partially composed of a material that consists predominantly of one or more of the metals iron, zinc and/or aluminum, comprising contacting the metal component with an acidic aqueous composition containing components:

a) at least 0.003 wt. % of aliphatic diols having at least 4 carbon atoms but no more than 10 carbon atoms;

b) at least 0.01 wt. % of aliphatic saturated polyhydroxy compounds having at least 4 but no more than 8 carbon atoms;

c) at least one water-soluble compound of Zr and/or Ti;

d) at least one water-soluble source of fluoride ions.

2. The method according to claim 1, wherein the of polyhydroxy compounds of component b) have a ratio by mass to the aliphatic diols of component a) of at least 0.4 and no greater than 20.0.

3. The method according to claim 1, wherein hydroxyl groups of the aliphatic diol according to component a) are interconnected by means of no more than 3 carbon atoms.

4. The method according to claim 3, wherein the aliphatic diol according to component a) is selected from acyclic alkane diols having no more than 8 carbon atoms but at least 5 carbon atoms.

5. The method according to claim 3, wherein the aliphatic diol according to component a) comprises 2-methylpentane-2,4-diol.

6. The method according to claim 1, wherein the polyhydroxy compounds according to component b) have more than three hydroxyl groups, and at least two of the hydroxyl groups are interconnected by means of no more than two carbon atoms.

7. The method according to claim 1, wherein in total at least 0.002 wt. % and no more than 0.2 wt. % of the at least one water-soluble compound of Zr and/or Ti, calculated as an amount Zr, are present in the acidic aqueous composition.

8. The method according to claim 1, wherein the acidic aqueous composition has a pH of below 6.0 and above 2.0 and has a free acid content of at least 1 point.

9. The method according to claim 1, wherein the acidic aqueous composition contains component d) the at least one water-soluble source of fluoride ions in such an amount that the acidic aqueous composition has a free fluoride proportion of at least 10 mg/kg.

10. The method according to claim 1, wherein the acidic aqueous composition additionally contains calcium and/or magnesium ions.

11. The method according to claim 1, wherein the metal component consists at least in part of a ferrous material.

12. The method according to claim 1, wherein the contacting of the metal component with the acidic aqueous composition comprises spraying on or spraying at spray pressure of at least 1 bar.

13. The method according to claim 1, wherein upon contacting the metal component, the acidic aqueous composition has a temperature of less than 40° C. but at least 20° C.

14. The method according to claim 1, wherein, directly after contacting the metal component with the acidic aqueous composition, with or without an intermediate rinsing and/or drying step, regions of the metal component contacted with the acidic aqueous composition are immersion coated or powder coated, at least in part.

15. The method according to claim 1, wherein no wet-chemical cleaning of the metal component directly before the contacting with the acidic aqueous composition.

16. The method according to claim 2, wherein the ratio by mass of the polyhydroxy compounds of component b) to the aliphatic diols of component a) is at least 2.0 and no greater than 6.0.

17. The method according to claim 1, wherein the polyhydroxy compounds according to component b) are selected from erythritol, threitol, xylitol, arabitol, ribitol, mannitol or sorbitol, and combinations thereof.

18. The method according to claim 1, wherein in a total amount of at least 0.005 wt. %, of the water-soluble compounds of Zr and/or Ti, calculated as an amount Zr, are contained in the acidic aqueous composition.

19. The method according to claim 1, wherein the acidic aqueous composition has a pH of below 5.5, but above 3.0.

20. The method according to claim 1, wherein the acidic aqueous composition additionally contains in total at least 0.01 wt. % of calcium and/or magnesium ions.

21. An acidic aqueous chromium(VI)-free and phosphate-free composition comprising:

a) 0.003-2 wt. % of aliphatic diols having at least 4 carbon atoms but no more than 10 carbon atoms;

b) 0.01-5 wt.% of aliphatic saturated polyhydroxy compounds having at least 4 but no more than 8 carbon atoms;

c) 0.002-0.2 wt. % of water-soluble compounds of Zr, calculated as an amount of Zr;

d) at least 10 mg/kg of free fluoride ions; and e) optionally 0.01-1 wt. % of calcium and/or magnesium ions.

22. The acidic aqueous chromium(VI)-free and phosphate-free composition of claim 21, wherein the aliphatic saturated polyhydroxy compounds of component b) have a ratio by mass to the aliphatic diols of component a) is of at least 0.4 and no greater than 20.0.

23. The acidic aqueous chromium(VI)-free and phosphate-free composition of claim 22, wherein hydroxyl groups of the aliphatic diol according to component a) are interconnected by means of no more than 3 carbon atoms.

24. The acidic aqueous chromium(VI)-free and phosphate-free composition of claim 22, wherein the aliphatic diol according to component a) is selected from acyclic alkane diols having no more than 8 carbon atoms but at least 5 carbon atoms.

25. The acidic aqueous chromium(VI)-free and phosphate-free composition of claim 24, wherein the aliphatic diol according to component a) comprises 2-methylpentane-2,4-diol.

26. The acidic aqueous chromium(VI)-free and phosphate-free composition of claim 24, wherein the aliphatic saturated polyhydroxy compounds according to component b) have more than three hydroxyl groups, and at least two of the hydroxyl groups are interconnected by means of no more than two carbon atoms.

27. The acidic aqueous chromium(VI)-free and phosphate-free composition of claim 24, wherein the acidic aqueous composition has a pH of below 6.0 and above 2.0 and has a free acid content of at least 1 point.

28. The acidic aqueous chromium(VI)-free and phosphate-free composition of claim 24, wherein the ratio by mass of the aliphatic saturated polyhydroxy compounds of component b) to the aliphatic diols of component a) is at least 2.0 and no greater than 6.0.

29. The acidic aqueous chromium(VI)-free and phosphate-free composition of claim 28, wherein the aliphatic saturated polyhydroxy compounds according to component b) are selected from erythritol, threitol, xylitol, arabitol, ribitol, mannitol, sorbitol, and combinations thereof.

30. The acidic aqueous chromium(VI)-free and phosphate-free composition of claim 29, wherein the water-soluble compounds of Zr and/or Ti, calculated as an amount of Zr, are present in the acidic aqueous composition in an amount of at least 0.005 wt. %.

31. The acidic aqueous chromium(VI)-free and phosphate-free composition of claim 30, wherein the acidic aqueous composition has a pH of below 5.5, but above 3.0 and the calcium and/or magnesium ions are present in the acidic aqueous composition in an amount of at least 0.01 wt. %.

* * * * *